United States Patent [19]

Patel

[11] 4,179,250

[45] Dec. 18, 1979

[54] THREAD CONSTRUCTION FOR ROTARY WORM COMPRESSION-EXPANSION MACHINES

[75] Inventor: Ghanshyam C. Patel, Franklin, Pa.

[73] Assignee: Chicago Pneumatic Tool Company, New York, N.Y.

[21] Appl. No.: 848,591

[22] Filed: Nov. 4, 1977

[51] Int. Cl.[2] ..... F01C 1/08; F04C 17/04

[52] U.S. Cl. ..... 418/195

[58] Field of Search ..... 418/195, 220; 74/458

[56] References Cited

U.S. PATENT DOCUMENTS

| | | | |
|---|---|---|---|
| 3,841,806 | 10/1974 | Zimmern | 418/195 |
| 3,905,731 | 9/1975 | Zimmern | 418/195 |

*Primary Examiner*—John J. Vrablik

*Attorney, Agent, or Firm*—Lane, Aitken & Ziems

[57] ABSTRACT

A rotary worm fluid working machine in which a casing enclosed rotor, cooperable with one or more rotary pinions, is provided with a plurality of spiral thread grooves each having convergent side surfaces so that teeth on the pinion wheel enter the thread grooves with a clearance diminishing to contact prior to tooth exit. The clearance reduces shock loading on the pinion wheel and reduces pinion wheel tooth seal wear in conical worm machines due to relatively lower rotor-pinion wheel tooth velocities in the region of tooth seal-rotor contact.

8 Claims, 9 Drawing Figures

12
14
16
18
20
22
24
25
26
28
30
32
34
36
38
40
42
44
10

THREAD CONSTRUCTION FOR ROTARY WORM COMPRESSION-EXPANSION MACHINES

BACKGROUND OF THE INVENTION

This invention relates to rotary worm compression-expansion machines and more particularly, it concerns a novel thread configuration for the rotors of such machines.

The disclosures of U.S. Pat. No. 3,180,565, issued Apr. 27, 1965, U.S. Pat. No. 3,632,239 issued Jan. 4, 1972 and U.S. Pat. No. 3,905,731 issued Sept. 16, 1975, all to the inventor, Bernard Zimmern, exemplify the current state-of-the-art relative to rotary worm compression-expansion machines. In such machines, a single threaded rotor is contained in a housing so that each groove lying between a pair of threads defines with the housing an elongated chamber. As the threaded rotor rotates relative to one or more pinion wheels carried by the housing for rotation on axes tangential to the rotor, each groove is swept by a pinion wheel tooth. Compression (or expansion) of fluid in each groove occurs due to the positioning of outlet porting in the housing relative to pinion wheel location.

The machine rotors may be of either generally cylindrical or conical configuration, the latter being preferable for increased volumetric capacity due to a facility for providing concentric spiral threads on opposite sides of a single rotor, the threads on each side being cooperable with two pinion wheels. The structural organization of such a conical screw machine which has demonstrated significant commercial potential as a high capacity air compressor is fully disclosed in the last issued of the afore-mentioned U.S. Pat. No. 3,905,731.

In the operation of a conical screw machine of this type, pinion wheel teeth enter each thread groove in the rotor screw at the outside diameter of the rotor and move inwardly, following the spiral thread groove to a minimal radius on completion of each work cycle. The tangential speed of the rotor at its outside diameter is, of course, greater and this factor combined with the closure of each groove by a pinion wheel tooth at the outer diameter of the rotor can impose shock loading on the pinion wheel teeth. In addition, the relative speed of movement between rotor thread grooves and pinion wheel teeth at the outer peripheral edge of the rotor contributes an increase of friction resulting in pinion wheel wear. While machine designs in the prior art have shown substantial promise from the standpoint of providing a relatively simple, well-balanced and quiet operating air compressors, there is need for improvement from the standpoint of providing longer useful life of the pinion wheels used in such machines.

SUMMARY OF THE INVENTION

In accordance with the present invention, the problems associated with shock loading and wear of pinion wheel teeth in rotary worm compression-expansion machines, particularly though not exclusively conical-type rotary worm compessors, are substantially overcome by providing spiral thread grooves in the rotor of such machines with a slight constant taper so that the side surfaces of each groove converge inwardly from the point of pinion wheel tooth entry at the outer periphery of the rotor smoothly and continuously to a groove width near the inner groove end approximating the width of a pinion wheel tooth. Because two or more teeth on each pinion wheel are always in working engagement with the rotor at progressively outward radial points of consecutive thread grooves, a controlled clearance gap exists on opposite sides of each tooth on entering each groove, which gap diminishes to contact as the tooth progresses inwardly along the groove. As a result, pinion wheel tooth loading is progressive to a piont where damaging shock loading on the teeth is avoided. In addition, the frictional contact of each tooth with thread groove side surfaces in conical worm machines occurs only at the reduced inner radii of the rotor where the relative velocity of rotor-tooth movement is minimal. Accordingly, pinion wheel tooth seal wear is reduced.

Among the objects of the present invention are, therefore: the provision of an improved rotary worm compression-expansion machine in which shock loading on component parts is reduced to a minimum; the provision of an improved conical-type rotary worm compressor in which spiral thread grooves are swept by pinion wheel teeth moving in a direction inwardly from the outer peripheral edge of the rotor; the provision of such a compressor in which shock loading on pinion wheel teeth is minimized; the provision of such a compressor in which pinion wheel tooth wear is reduced; and the provision of an improved rotor thread groove construction for such rotary worm compression-expansion machines.

Other objects and further scope of applicability of the present invention will become apparent from the detailed description to follow taken in conjunction with the accompanying drawings in which like parts are designated by the same reference numerals.

DETAILED DESCRIPTION OF THE PREFERRED EMBODIMENT

Figure 1:
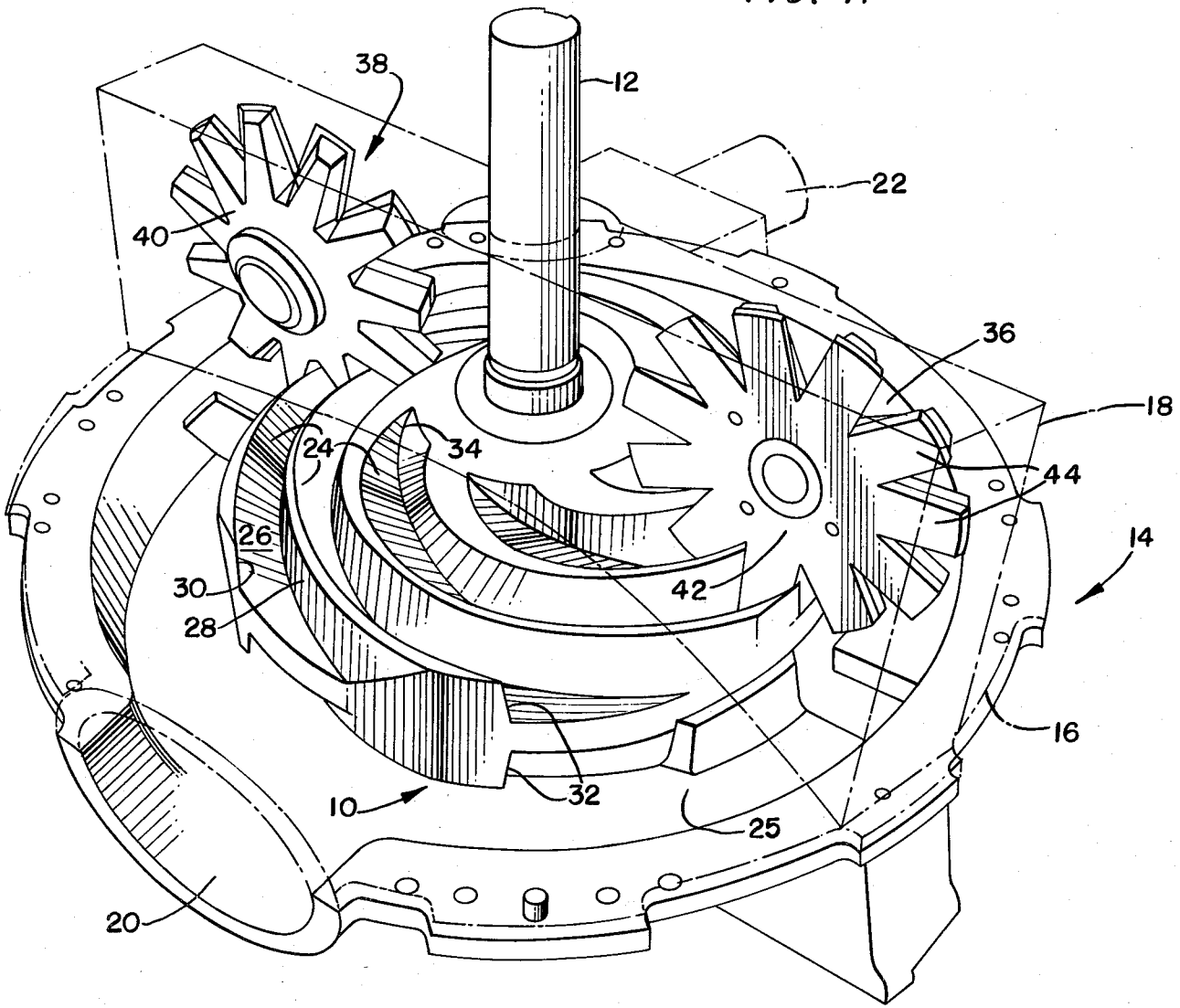
FIG. 1 is a perspective view illustrating a rotary worm compression-expansion machine incorporating the present invention.

In FIG. 1 of the drawings, a rotary worm compression-expansion machine is shown to include a conical rotor 10 having a central shaft 12 journalled for rotation in a casing 14 defined by axially bolted casing halves 16 and 18, the latter of which is illustrated in phantom lines to facilitate illustration of working components. The general machine structure illustrated in FIG. 1 is substantially identical with the disclosure of U.S. Pat. No. 3,905,731, above-cited, and the disclosure of this patent is expressly incorporated herein by reference to the extent that it is needed to enable one skilled in the art to practice the present invention. Also, and as is well-known in the art, such machines are reversible; that is, they may be operated either as a compressor or pump by the application of mechanical energy to the rotor shaft 12 or as motors by the application of fluid energy resulting in a torque output in the shaft 12. In the ensuing description, the machine illustrated will be described as a compressor though it is to be understood that the inventive features may be embodied in structure applicable to a machine adapted for use as a motor or fluid expansion machine as well.

As a compressor, the machine illustrated in FIG. 1 includes a casing inlet 20 and outlet 22 from which a working fluid such as compressed air may be delivered. Fluid entering through the inlet 20 passes to a series of spiral thread grooves 24 in the rotor 10 each of which define closed elongated spiral channels with an inner annular surface 25 on the adjacent casing half 16 or 18. The thread grooves 24 are each defined by a root surface 26 joining at opposite sides with leading and trailing thread side surfaces 28 and 30, respectively. Each thread groove 24 opens through a low pressure end at an outer radial portion of the rotor 10, specifically at the rotor periphery in the disclosed embodiment, to present an essentially rectangular entry mouth 32 and extends inwardly in a spiral path to a discharge or high pressure end 34 of essentially triangular cross-section near the center of the rotor 10. At the extreme inner end 34 the groove is defined only by the root and trailing side surfaces 28 and 30.

It is to be noted that in conical rotors, the thread grooves 24 approach a classically spiral configuration in the sense that the radius of groove curvature is infinitely variable. In cylindrical rotors, however, the equivalent grooves are more aptly characterized as classically helical because they are formed in a cylindrical face. The term "spiral", as used herein and in the appended claims, therefore, is intended to encompass both classically spiral and classically helical thread groove configurations.

The casing is shaped to house a pair of rotatable pinion wheels 36 and 38 on each axial side of the rotor 10. As shown in FIG. 1, the pinion wheels are supported rotatably on axes extending tangentially of the rotor 10 and displaced from the central plane of the rotor. Further, each of the pinion wheels 36, 38 are identically constructed to include a supporting body 40 carrying a disc-like seal 42 on one face thereof. The body 40 and the seal 42 are shaped to provide a plurality of equally spaced, radiating teeth 44 to extend through the casing surface 25 and into each groove 24.

Since the basic operation of the machine illustrated in FIG. 1 as a compressor is described in the afore-mentioned U.S. Pat. No. 3,905,731, this operation will be only cursorily summarized herein. Thus, as the rotor 10 is driven by torque applied to the shaft 12, the pinion wheels 36 and 38 will be rotated so that each tooth 44 thereon enters a thread groove 24 at the mouth 32 thereof. Continued rotation of the rotor 10 and pinion wheels results in closure of the chamber defined by each thread groove, casing surface and pinion wheel tooth at the low pressure end thereof and subsequent reduction in volume of such chamber to effect a compression of fluid contained therein. Since two or more teeth on each pinion are always in working engagement with the rotor 10, successive entry of each tooth into the mouth 32 of a thread groove 24 is automatically synchronized. It will be noted also that as each pinion wheel tooth enters the mouth 32 of a thread groove 24, compressive work will not be initiated until the plane of the tooth meets or intersects the trailing side surface 30 of each groove. In other words, the mouth 32 is progressively closed by each pinion wheel tooth 44 as a result of the geometric configuration of the illustrated machine. For this reason, the term "low pressure end" as used herein and in the appended claims is intended to delineate a working end of each groove 24 as distinguished from the entry mouth 32 in which only the leading side surface 28 is adjacent to pinion wheel tooth with no work being done because of nonclosure of the tooth with the trailing groove side 30.

In the use of the illustrated machine to compress air, for example, it will be appreciated that each of the thread grooves 24 is filled with air prior to the time a tooth 44 on the pinion wheels enters the groove. Since the discharge or high pressure end 34 of each groove at this time is sealed by the casing, the pinion wheel teeth may be subjected to severe shock loading on closing the opened outer or low pressure end of each groove, particularly where the rotor is operated at high speeds. Such shock loading can be detrimental to the pinion wheels and has in some instances of actual experience resulted in breakage of the pinion wheel teeth.

Figure 2:
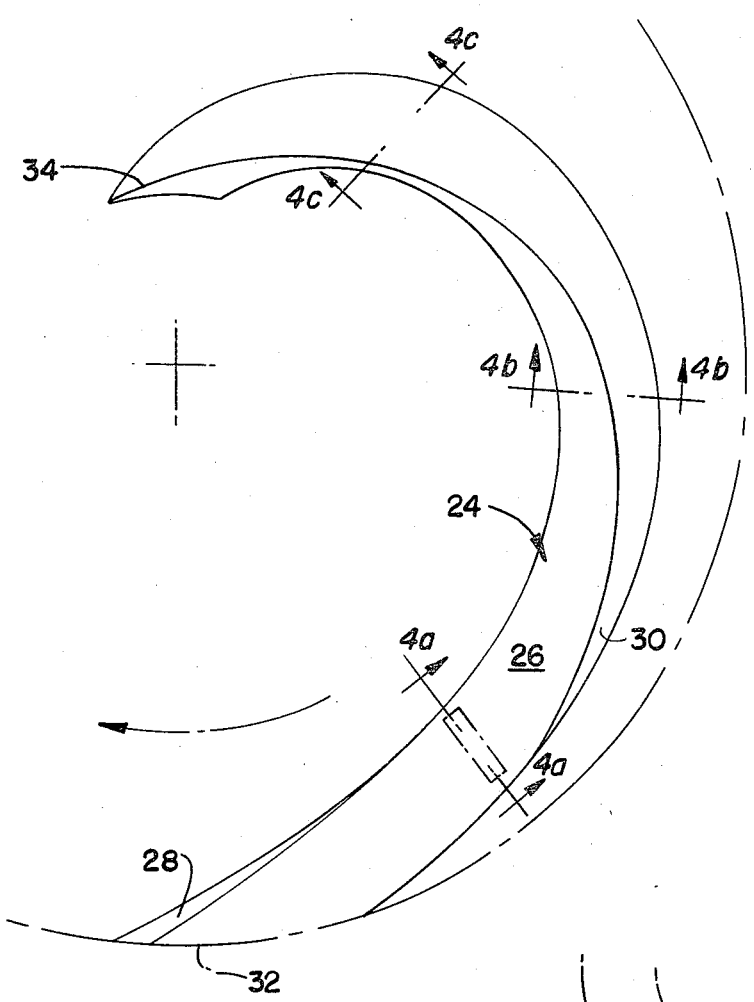
FIG. 2 is a fragmentary plan view illustrating the thread groove configuration of the rotor illustrated in FIG. 1.
Figure 3:
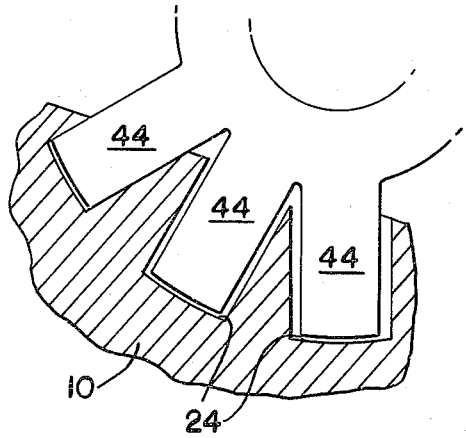
FIG. 3 is a fragmentary radial cross-section through the rotor illustrated in FIG. 1 at the approximate plane of the pinion wheels also shown in that figure.
Figure 4A:
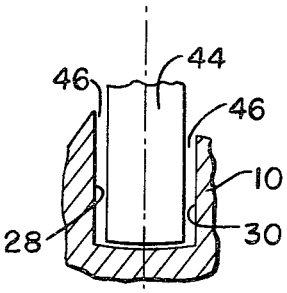
FIGS. 4*a*, 4*b* and 4*c* are fragmentary cross-section on correspondingly designated section lines in FIG. 2.
Figure 4B:
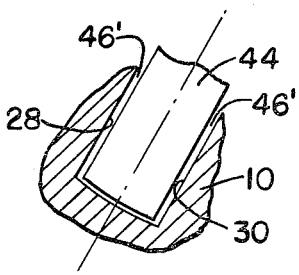
Figure 4C:
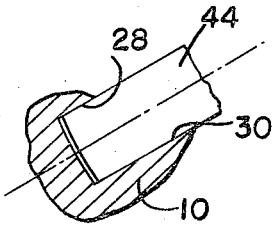

In accordance with the present invention, and as shown most clearly in FIGS. 2–4 of the drawings, each of the thread grooves 24 is machined in the rotor 10 in such a manner that the cross-sectioanl size of each groove 24 near the low pressure end and mouth 32 is larger than the effective size of each pinion wheel tooth and is progressively reduced toward the exit 34. In particular, the side surfaces 28 and 30 converge toward each other from the mouth 32 to the groove exit 34. Though exaggerated in the illustration of FIG. 3 and 4, this tapering convergence of each groove 24 results in a spacing or gap 46 on opposite sides of each tooth 44 which is maximum in the region of the low pressure end and mouth 32 of each groove and diminishes to sealing engagement or contact toward the discharge end 34 of each groove.

In practice, the dimensions of the clearance gaps 46 on opposite sides of each of the pinion teeth may vary both by design and as a result of machining tolerances. To illustrate the general nature of the gap dimensions, however, excellent results have been achieved in practice where the clearance gaps 46 are on the order of 0.0030 inches in the region of the groove entry as depicted in the drawing by the location of the section *4a—4a;* 0.0015 inches in the central region of the groove or in the vicinity of the section *4b—4b* of FIG. 2 and decreasing to 0.0000 in advance of the exit end 34 of each groove or in the region of the section *4c—4c* of FIG. 2. Since the relative velocity of the rotor 10 and the pinion wheel teeth 44 near the exit end 34 of each groove 24 is 75% less than that in the region of the entry mouth 32, seal wear is reduced significantly by comparison to machines in which rotor thread grooves are designed to be of constant width throughout their lengths.

It has been found additionally that overall machine efficiency is not in any way reduced by the converging groove side walls and the resulting clearance gap 46 toward the entry end of each groove. This is due in substantial part to the fact that the pressure of fluid in the groove on entry of each tooth 44 is relatively low. Moreover, the clearance gap diminishes with increasing pressure so that leakage through the gap is not a problem. It it noted further that because of the converging groove design and reduction in pinion tooth seal wear, the leakage past the pinion wheel teeth is less with the present invention than where grooves of constant width have been employed. This is believed in part due to machining tolerances and lack of control over seal wear in prior machines to a point where clearance gaps occur near the end of each groove when pressures are high.

Figure 5:
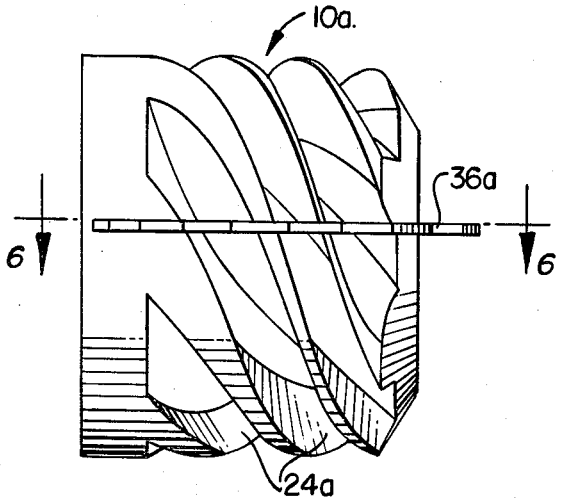
FIG. 5 is an elevation illustrating the rotor and pinion wheel of a cylindrical worm compression-expansion machine incorporating the present invention.
Figure 6:
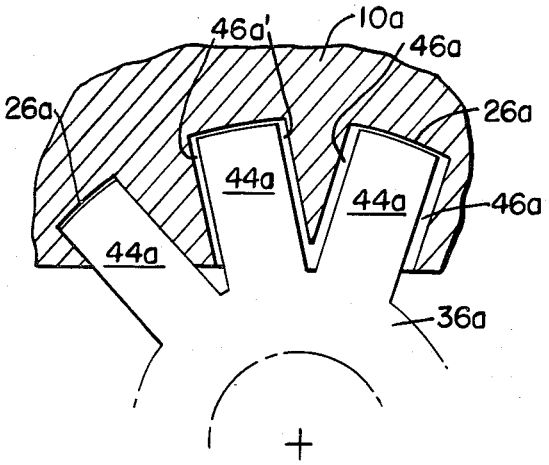
FIG. 6 is a fragmentary cross-section on line 6—6 of FIG; 5.

For the reasons set forth above, the described and illustrated construction of the thread grooves 24 is preferred from the standpoint of optimizing achievement of both reduced pinion wheel seal wear and reduced shock loading on the pinion wheel teeth. It is contemplated, however, that either one or both of these advantages may be realized in other thread groove configurations. In cylindrical rotary worm machines, for example, the pinion wheels are located essentially in planes parallel to the axis of the rotor so that the relative velocity of pinion wheel teeth and rotor grooves does not change during progression of the fluid working operation effected by the rotor and pinion wheels. The adaptation of the invention to a cylindrical worm compression-expansion machine is illustrated in FIGS. 5 and 6 of the drawings in which parts corresponding to parts illustrated in FIGS. 1–4 are designated by the same reference numeral with an "a" suffix. While the use of converging thread groove side walls in cylindrical rotors would not result in the same magnitude of reduced pinion wheel seal wear, the reduction of shock loading on pinion wheel teeth would be similar to that explained above with respect to conical rotors.

Figure 7:
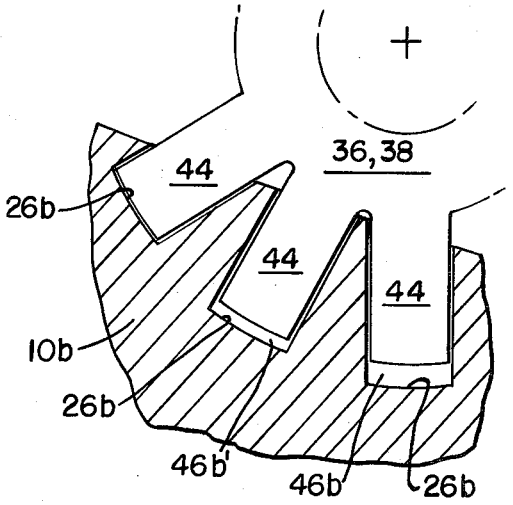
FIG. 7 is a fragmentary radial cross-section through the rotor illustrated in FIG. 1, as FIG. 3, but illustrating a modified form of the invention.

Similarly, the provision of the clearance gap 46 on opposite sides of the pinion wheel teeth offers the advantage of tooth entry of each groove 24 without danger of mechanical impact as may occur due to machining tolerances. On the other hand, the shock loading on the pinion wheel teeth during the fluid working cycle would be equally reduced as compared with prior machines by providing an initial clearance between the end of the pinion wheel teeth and the root 26 of each groove. Such an arrangement is illustrated in FIG. 7 where parts identical to those of the embodiment in FIG. 1 are designated by the same reference numerals and where modified but corresponding parts are designated by the same reference numerals with a "b" suffix. Such a root clearance would, of course, diminish to contact as the fluid working cycle progressed in the same manner as the described embodiment.

Thus it will be seen that as a result of the present invention, a significantly improved rotary worm compression-expansion machine is provided and by which the above-mentioned objectives are completely fulfilled. Also as pointed out above, it is contemplated that various modifications and/or changes in the embodiment disclosed herein may be made without departure from the inventive concepts manifested by the disclosed embodiment. Accordingly, the foregoing description is intended as illustrative only, not limiting, and that the true spirit and scope of the present invention be determined by reference to the appended claims.

I claim:

1. In a rotary worm compression-expansion machine having a rotor supported in a casing for rotation on a first axis, the rotor having a plurality of spirally extending threads to establish correspondingly spiral grooves having opposite high and low pressure ends, each having a root surface lying between a pair of side surfaces at the low pressure end and extending toward the opposite high pressure end, the casing having an inner surface portion defining with the spiral grooves a plurality of compression-expansion chambers, and at least one rotary pinion wheel supported rotatably in the casing on a second axis tangential to the rotor and having radiating teeth projecting through the inner casing surface into the grooves so that rotation of the rotor and pinion wheel effects relative travel of each tooth between the high and low pressure ends of each groove to vary the volume of the compression-expansion chambers in the performance of a fluid working operation, the improvement comprising: means defining each groove with a cross-sectional size at the low pressure end thereof larger than the effective size of each pinion wheel tooth, the cross-sectional size of each groove being progressively reduced toward the high pressure end thereof to effect sealing contact between the groove surfaces and each pinion wheel tooth as each tooth moves relative to the rotor in the region of the high pressure end portion of each groove.

2. The apparatus recited in claim 1 wherein the spiral grooves are formed in a conical rotor and extend from an outer radial portion of the rotor to an inner radial portion thereof.

3. The apparatus recited in claim 1 wherein the side surfaces of each groove converge toward the high pressure end from a root width in excess of pinion wheel tooth width.

4. The apparatus recited in claim 3 wherein the convergence of the groove side walls is symmetrical to provide an essentially equal clearance gap between the side walls of each groove at opposite sides of each pinion wheel tooth.

5. The apparatus recited in claim 4 wherein the spiral grooves are formed in a conical rotor and wherein each groove opens as a generally rectangular mouth at the periphery of the rotor and wherein the clearance gap on opposite sides of each tooth after entering said mouth is approximately 0.0030 inches.

6. In a rotary worm compressor having a conical rotor supported rotatably on a first axis in a casing having a fluid inlet outside the rotary periphery and a fluid outlet near the rotor axis, the rotor having a plurality of spirally extending threads to establish correspondingly spiral grooves, each having a root surface lying between a pair of side surfaces at an outer portion of the rotor and extending radially inward of the rotor toward an inner end, the casing having an annular inner surface portion defining with the spiral grooves a plurality of compression chambers, and at least one rotary pinion wheel supported rotatably in the casing on a second axis tangential to the rotor and offset axially from the plane of the rotor, the pinion wheel having radiating teeth projecting through the inner casing surface into the grooves so that rotation of the rotor and pinion wheel reduces the volume of the compression chambers to compress fluid contained in the chambers, the improvement comprising:

means defining each groove with a root width at the rotor periphery in excess of pinion wheel tooth width thereby to provide a clearance gap between the groove side walls and opposite sides of each pinion wheel tooth, the side walls converging centrally of the rotor to establish contact with the opposite sides of each pinion wheel tooth only in the region of the inner end of each groove.

7. The apparatus recited in claim 6 wherein the clearance gap on opposite sides of each tooth on entering each groove is approximately 0.0030 inches.

8. The apparatus recited in claim 7 wherein the side surfaces of each groove are leading and trailing surfaces, wherein said leading surface terminates outwardly of the inner end of each groove, and wherein said clearance gap approximately midway along the length of said leading side surface is 0.0015 inches.

* * * * *